US005181564A

United States Patent [19]

Lindley et al.

[11] Patent Number: 5,181,564

[45] Date of Patent: Jan. 26, 1993

[54] MILLING TOOL

[75] Inventors: John D. Lindley; Colin R. Mackenzie, both of Aberdeen; Mark E. Hall, Kintore, all of United Kingdom

[73] Assignee: Weatherford-Petco, Inc., Houston, Tex.

[21] Appl. No.: 774,048

[22] Filed: Oct. 8, 1991

[30] Foreign Application Priority Data

Oct. 10, 1990 [GB] United Kingdom ..... 9022062

[51] Int. Cl.[5] ..... E21B 10/26

[52] U.S. Cl. ..... 166/55.6; 175/406

[58] Field of Search ..... 166/55, 55.6, 55.7, 166/55.1; 407/2, 6, 100, 116; 408/213, 144, 223, 227; 175/406

[56] References Cited

U.S. PATENT DOCUMENTS 5,058,666 10/1991 Lynde et al. ..... 166/55.6

5,074,356 12/1991 Nett ..... 166/55.7

*Primary Examiner*—William P. Neuder

*Attorney, Agent, or Firm*—Gunn, Lee & Miller

[57] ABSTRACT

A tool for milling a down-hole casing or tubing comprising a tubular body rotatable about its longitudinal axis and having a longitudinal passage therethrough. Means is provided at a first end of the cylindrical body for connection to a drive means to rotate the body. The first end forms the upper end of the body in the working position. At least one first blade extends outwardly from the cylindrical body and has a lowermost cutting edge extending upwardly from its innermost portion at an angle of from about 2° to about 60° to a radial plane perpendicular to said longitudinal axis, and at least one second blade extends outwardly from the cylindrical body and has a lowermost cutting edge extending downwardly from its outermost portion at an angle of from about 2° to about 60° to a radial plane perpendicular to said longitudinal axis.

14 Claims, 6 Drawing Sheets

MILLING TOOL

This invention relates to a tool which is used to cut tubular bodies and particularly for cutting a length of casing or tubing in a gas or oil well.

Milling tools for removing lengths of casing from oil wells or the like generally comprise a cylindrical body with a plurality of spaced blades located towards the lower end thereof. The blades have either crushed carbide or cutting elements thereon and cut directly on the upper face of the casing. The metal cuttings are then removed from the well by circulating mud down the centre of the tool. In many of the tools heretofore, however, the cuttings or shavings were too large and tended to clump together like a bird's nest which was then difficult to remove from the well. As a result the overall penetration rate of the tool was slowed.

It is an object of the present invention to provide a milling tool with good chip control.

It is a further object of the invention to provide a milling tool which can achieve a good penetration depth with the same set of blades.

According to the invention there is provided a tool for milling a down-hole casing or tubing comprising a tubular body rotatable about its longitudinal axis and having a longitudinal passage therethrough;

means at a first end of the cylindrical body for connection to a drive means to rotate the body, said first end to form the upper end of the body in the working position;

at least one first blade extending outwardly from the cylindrical body and having a lowermost cutting edge extending upwardly from its innermost portion at an angle of from about 2° to about 60° to a radial plane perpendicular to said longitudinal axis;

at least one second blade extending outwardly from the cylindrical body and having a lowermost cutting edge extending downwardly from its outermost portion at an angle of from about 2° to about 60° to a radial plane perpendicular to said longitudinal axis.

By cutting edge, we mean the amount of edge that is actively cutting the casing.

The present milling tool cuts both the inside and outside diameters of the upper end of the casing in two distinctly different cuts. As a result, the contact area of the cutting edge is reduced, as opposed to cutting across the top face of the casing, and the chip control improved. Furthermore, the rate of cutting is improved, as is the length/depth of casing that can be cut before having to change the blades. To these ends it will be appreciated that the angle of any cutting edge can vary within fairly wide limits, suitably being about 2° to 60° preferably about 2° to about 45°, advantageously about 2° to about 20° and optimally about 10° to about 15°.

Preferably the radially innermost portion of the cutting edge of the first blade is located at a lower longitudinal location on the cylindrical body then the radially innermost portion of the cutting edge of the second blade. More preferably the radially innermost portion of the cutting edge of the first blade is substantially level with the radially outermost portion of the cutting edge of the second blade. By this arrangement the opposed cutting edges will both initially cut the casing. In a preferred embodiment the cutting edges of the first and second blades simultaneously cut the casing.

Although the angles of the opposed cutting edges (i.e. of the first and second blades) are most preferably equal to give equal wear and thus uniform cutting, it is also within the scope of the invention that the opposed angles are different.

For stability and better cutting action, it is preferred that the opposed cutting edges of the first and second blade are diametrically opposed. Similarly where there are a plurality of first blades and a plurality of second blades, the opposed cutting edges of the plurality of first and second blades would advantageously be diametrically opposed.

Furthermore although it is preferred to arrange the blades alternately so that each first blade is spaced between two second blades and visa versa, acceptable results can still be achieved with other arrangements albeit the stability of the tool may be effected.

For particularly good chip control, the cutting edges are preferably presented to the casing so as to be on or slightly below the centre line thereof at all times. In a preferred embodiment this is accurately achieved by fixing each blade in slots which are milled in the outside surface of the body and which extend longitudinally, parallel to the longitudinal axis of the body. The blades can still be presented, however , as with prior milling tools at a negative rake to the casing, which can have a chip breaking effect.

The blades are preferably provided with at least one cutting element which is arranged such the lowermost edge or edges of the cutting element or elements form the angled cutting edge of each blade. Cutting elements may comprise of for example, discs, squares, or triangles which can be used singularly or in a plurality (which includes mosaicing) to form a discontinuous or preferably continuous cutting edge. An example of a blade presented at a negative rake with disc like elements is shown in U.S. Pat. No. 4,796,709.

The cutting elements are preferably constructed to include chip breakers. This can comprise for example of a hollow or generally outwardly extending surface against which the cuttings abut. In results acceptable chip control has been achieved using elements which include a plurality of radially extending protrusions such as ridges to form chip breakers.

The invention will now be described by way of example only with reference to the accompanying drawings in which.

Figure 1:
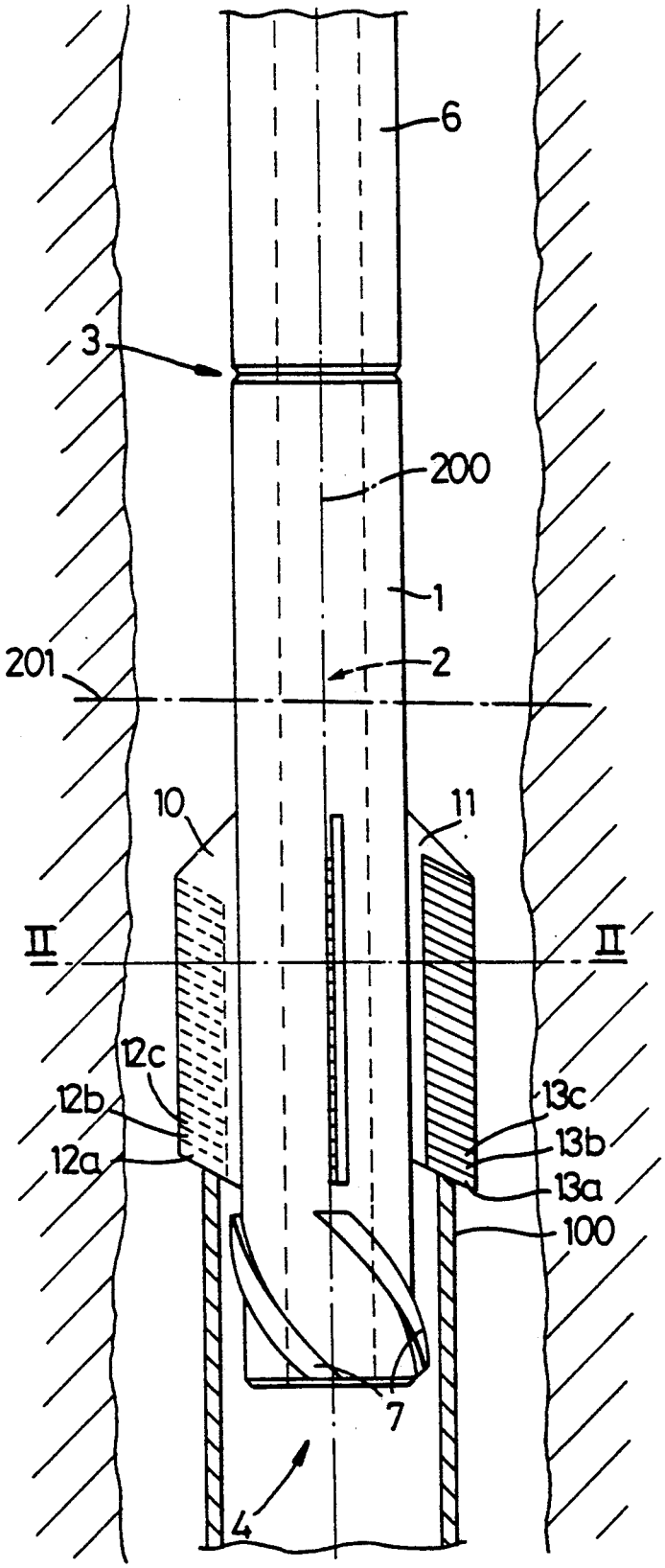
FIG. 1 is a longitudinal section through a bore hole to show a milling tool (unsectioned) of the present invention having eight blades and having cutting edges angled at 12.5° and engaging the upper end of a casing (shown sectioned)

Referring to the drawings, a milling tool is shown for milling the upper end of an inner steel casing 100 of a gas or oil well. The milling tool comprises a cylindrical body 1 rotatable about a longitudinal axis 200 and having radial axes 201, 202 perpendicular thereto (see FIGS. 7 and 8). On a figure of rotation, the radial axes form corresponding radial planes. An inner longitudinal passage 2 extends from the first end 3 of the body 1, which in use forms the upper end, along the longitudinal axis to the second (lower) end 4 thereof. Mud is circulated through this passage 2 to remove chips 101 (see FIG. 5) from the casing 100.

The first end of the body 1 is provided with a connecting male piece (shown generally by 5 in FIG. 7) for connection to a drill string 6 (FIG. 1), and the second end of the body 1 is provided with a plurality of circumferentially spaced spiral stabilizer ribs 7 which in use are positioned within the upper end of the casing 100 (FIG. 1).

Figure 9:
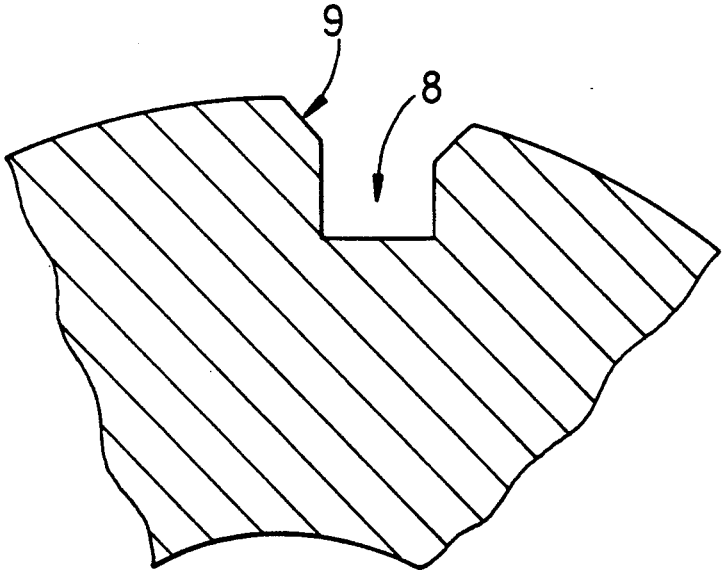
FIG. 9 is an enlarged cross sectional view of a slot shown on FIG. 8.

Equi-spaced around the body 1 above the stabilising ribs 7 are a series of six longitudinally extending slots 8 with chamfered outer portions 9 (FIG. 9). These slots 8 extend parallel to the longitudinal axis 200 of the body and are offset from radial axis 201 (FIG. 2) by about the thickness of a cutting element (12, 13 see hereinafter).

A plurality of planar first and second blades 10 and 11 respectively are fixed by welding into the slots 8 and alternately located with respect to one another around the body 1.

Each first blade 10 has a first connectable longitudinal side 10*a* and a second and third smaller side 10*b* and 10*c*, perpendicular thereto at either end. These first to third sides are received within one of the slots 8. A fourth side 10*d*, which is intended to be at the upper end in use, is angled at 45° between the third side 10*c* and a fifth longitudinal side 10*e* which is parallel to the first side 10*a*. A sixth side 10*f* which in use forms the lower end of the blade 10 extends at 12.5° between the second and fifth sides 10*b* and 10*e*. This angle is formed between a first radial axis or plane 201, perpendicular to the first edge 10*a* of the blade and the radially innermost portion of the sixth side which extends upwardly from the radial axis (FIGS. 3 and 7).

Figures 3, 4, 5, 6:
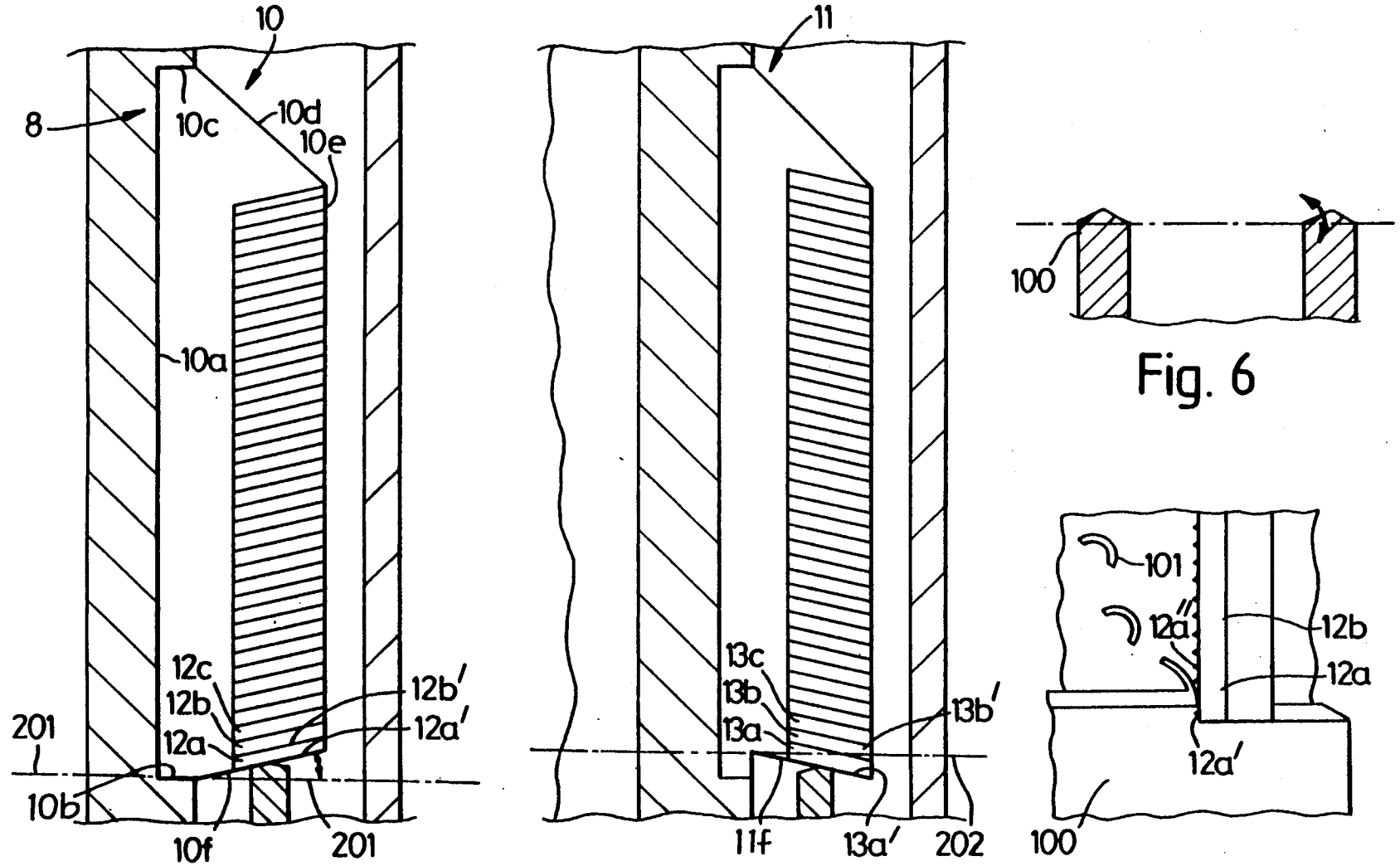
FIG. 3 is an enlarged view of a blade of the milling tool engaging the casing as shown in FIG. 1, with the body of the milling tool also shown in section for clarity.
FIG. 4 is an enlarged view similar to FIG. 3 of another blade of the milling tool.
FIG. 5 is an enlarged side view of the blade of FIG. 4 cutting the upper end of the casing.
FIG. 6 is a longitudinal sectional view of the upper end of the casing after it has been cut by a milling tool of the present invention.
Figure 7:
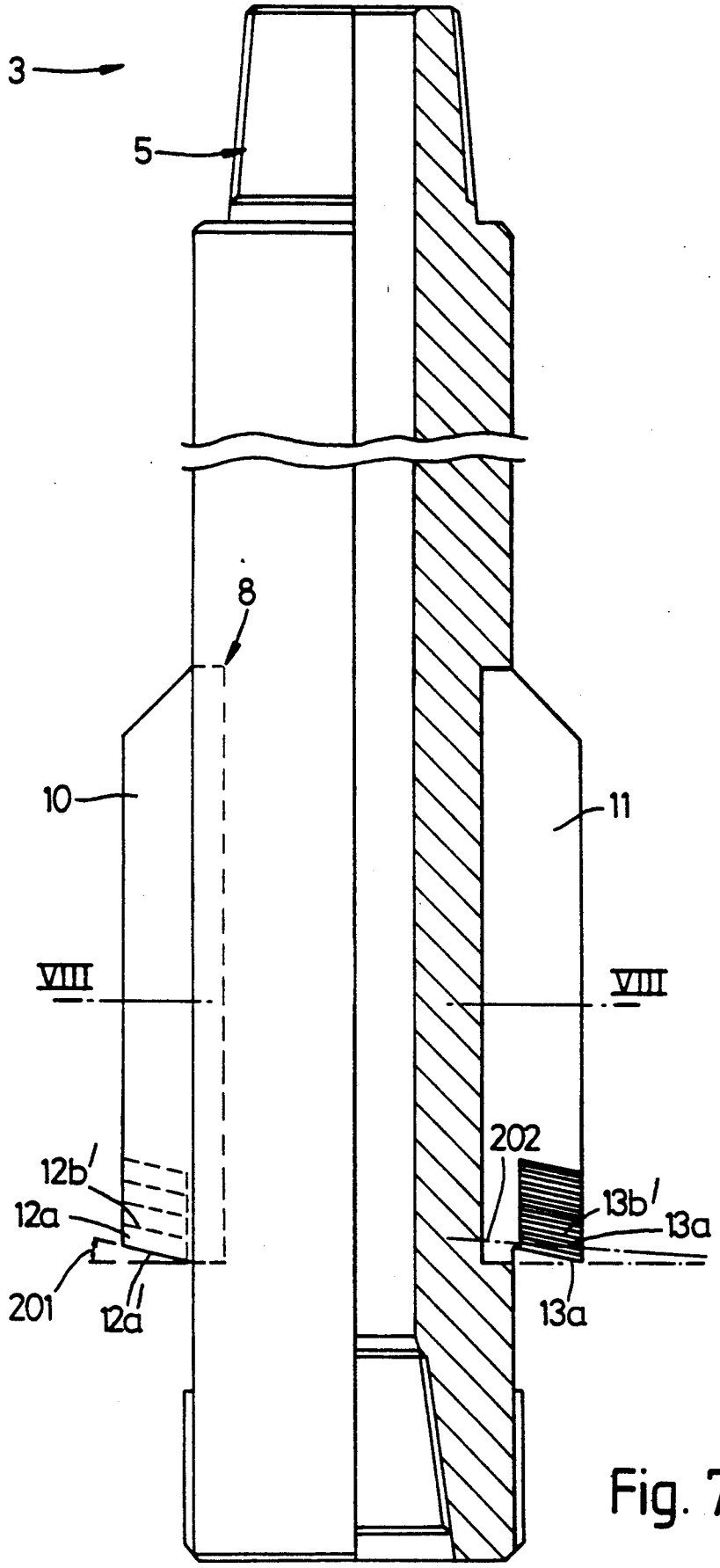
FIG. 7 is a front view of a second embodiment of a milling tool of the invention having six blades and being partly sectioned along its longitudinal axis.

Each second blade 11 is similarly shaped with the exception that the sixth side 11*f* is angled at 12.5° with respect to a second radial axis 202 and the radially innermost portion of the sixth side 11*f* which extends downwardly from the radial axis 202 (see FIGS. 4 and 7).

Figure 2:
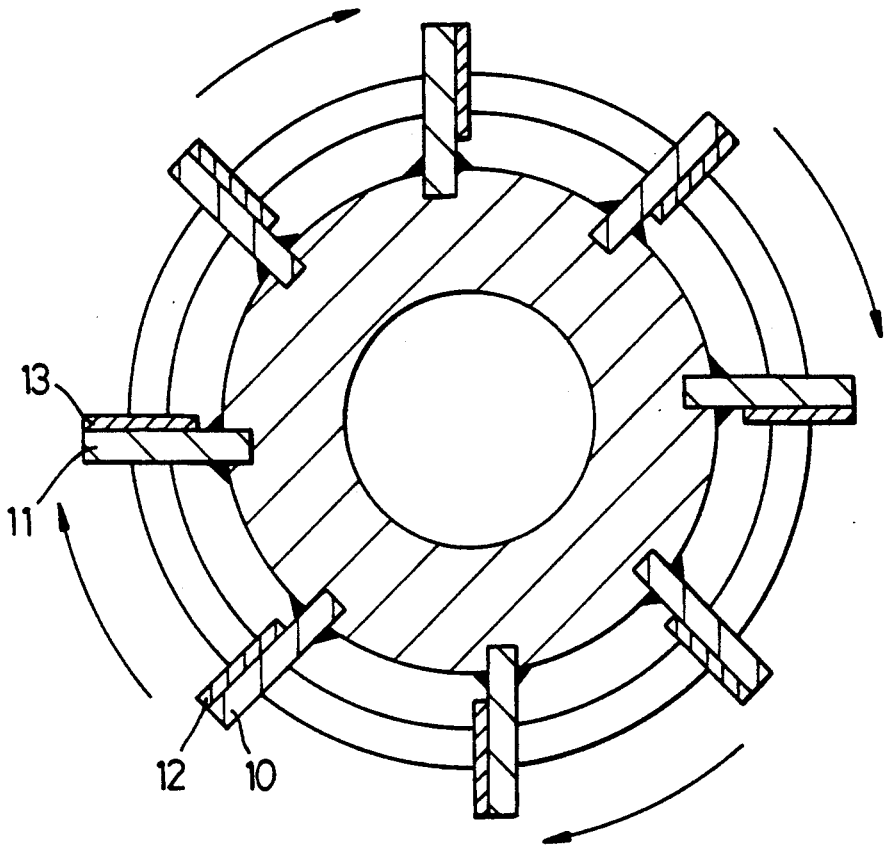
FIG. 2 is a cross sectional view along the line II—II of FIG. 1.
Figure 8:
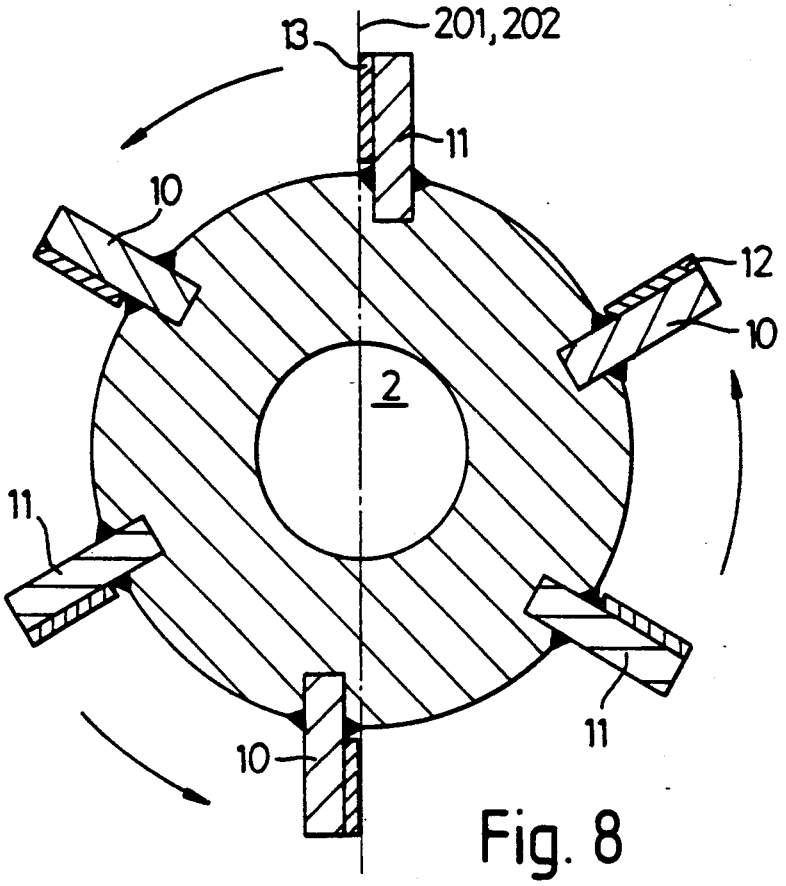
FIG. 8 is a cross-sectional view through the line VIII—VIII of FIG. 7.

To provide a means for cutting the casing 100 a plurality of first and second rectangular cutting elements 12 and 13, which may be formed of any suitable material such as cubic boron nitride (C.B.N) or titanium coated carbides, are brazed or rivetted onto the front faces (with respect to the direction of rotation shown arrowed in FIGS. 2 and 8) of the plurality of first and second blades 10 and 11 respectively so that the front faces of the cutting elements 12 and 13 lie substantially along radial axes of the body 1 and parallel to the longitudinal axis thereof (FIGS. 2 and 8). The cutting elements 12 and 13 are correspondingly angled at about 12.5° with the lowermost edge 12*a*′ or 13*a*′ of the respective lowermost element 12*a* or 13*a* aligning along the respective fifth side 10*a* or 11*a* of the first or second plurality of blades and extending about two thirds the length thereof to define cutting edges 12*a*′ or 13*a*′. Where the cutting edge does not extend radially, it can be defined as angled with respect to the corresponding radial planes of the body. In this particular embodiment the cutting edges 12*a*′, 13*a*′ of the respective first and second blades 10, 11 are of equal length and the innermost portion of each cutting edge 12*a*′ of each first blade 10 lies substantially on the same radial plane 20 as the outermost portion of each cutting edge 13*a*′ of each second blade 11. The outermost portion of the second blade cutting edge 13*a*′ similarly lies substantially on the same radial plane 202 as the innermost portion of the first blade cutting edge 12*a*′.

In the case of the plurality of first blades 10 (and thus plurality of first cutting edges 12*a*′), each cutting edge 12*a* is presented at 12.5° to the casing and cuts from the inside outwardly, whereas the second cutting edges 13*a*′ simultaneously cut the casing at an opposed angle of 12.5° from the outside inwardly. Furthermore the cutting edges are presented so as to be on or slightly below the centreline of the casing at all times. One main advantage of cutting in this manner is that the contact area between the cutting edge and casing is small and there is good chip control. A profile of a casing 100 which has been cut in accordance with the invention is illustrated in FIG. 6 with the cutting operation being partly illustrated in FIG. 5. As can be seen the upper face of the casing has two distinct cuts which form about a 12.5° angle between the inside diameter/outside diameter and a radial axis. This profile and angle of topface will, however, alter as the angle of the cutting edge alters.

Further cutting elements 12*b*, 12*c* or 13*b*, 13*c* etcetera extend at spaced intervals directly above the respective lowermost element 12*a* or 13*a* along the length of the blade 10 or 11. Each of these further elements 12*b*, 12*c*, 13*b*, 13*c* have a lower cutting edge 12*b*′, 13*b*′ etcetera also angled at about 12.5°. Thus when the lowermost element 12*a* or 12*b* (with respect to the unused blade) has worn away, the next lowermost element 12*b* or 13*b* then provides the cutting edge 12*b*, , 13*b*′ and so on up the full length of the blade.

For the avoidance of doubt the radially innermost portion of the cutting edge 12*a*′, 12*b*′, etcetera of the plurality of first blades 10 extends upwardly at 12.5° from said first radial axis 201, while the radially innermost portion of the cutting edge 13*a*′, 13*b*′ etcetera of the plurality of second blades extend downwardly from the second radial axis 202. As will be appreciated a number of transverse radial axis or planes could intersect the cutting edge at about 12.5°. The particular radial axis or planes 201, 202 shown with respect to the blade are only for convenience and illustrative of the invention. On projection, the cutting edges 12*a*′, 13*a*′ also intersect with these axis or planes 201, 202 at 12.5°.

Referring to the drawings, the cutting elements 12 or 13 are 1.5 inches long (3.81 cm) and have three spaced holes (not shown) for riveting them onto the blades. The elements in side profile have a saw-tooth formation defined by three ridges 12*a*″ or 13*a*″ (behind the initial cutting edge 12*a*′ or 13*a*′ and interspaced recesses which extend lengthwise of the rectangular elements (and thus radially of the blade 12 or 13). The ridges 12*a*″ or 13*a*″ act as chip beakers: the cuttings from the casing contact the ridges which cause them to break into small chips.

As the lowermost cutting edge 12*a'* or 13*a'* of the lowermost cutting element 12*a* or 13*a* is worn away, the next adjacent ridge 12*a''* acts as the cutting edge and so on from one cutting element to another along the length of the blades, as outlined previously.

Instead of or as well as having chips constructed with chip beakers, the cutting edges 12*a'*, 13*a'* of the tool could also be arranged at a negative rake such as shown in U.S. Pat. No. 4,796,709.

Figure 10:
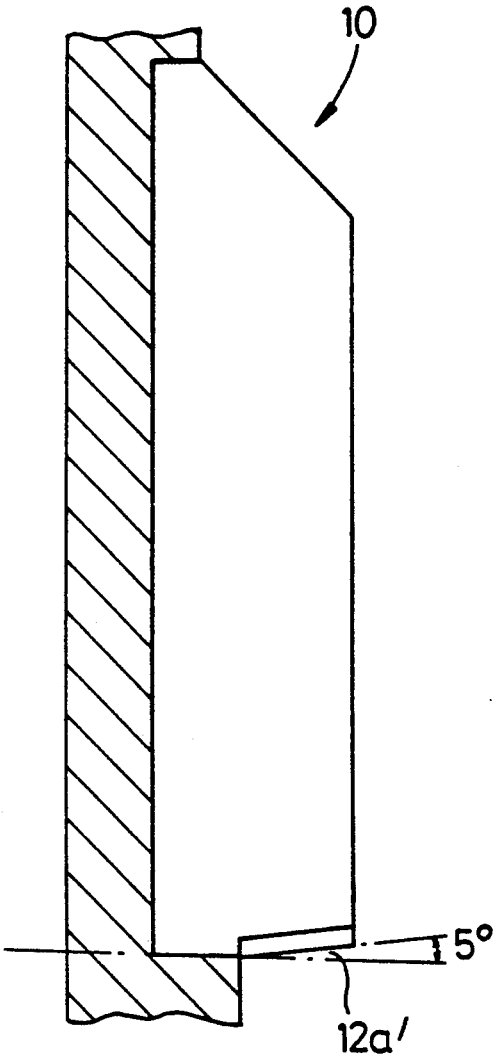
FIGS. 10 and 11 are enlarged views of a third and fourth embodiment of a blade of the milling tool having their cutting edges respectively angled at 5 and 30°.
Figure 11:
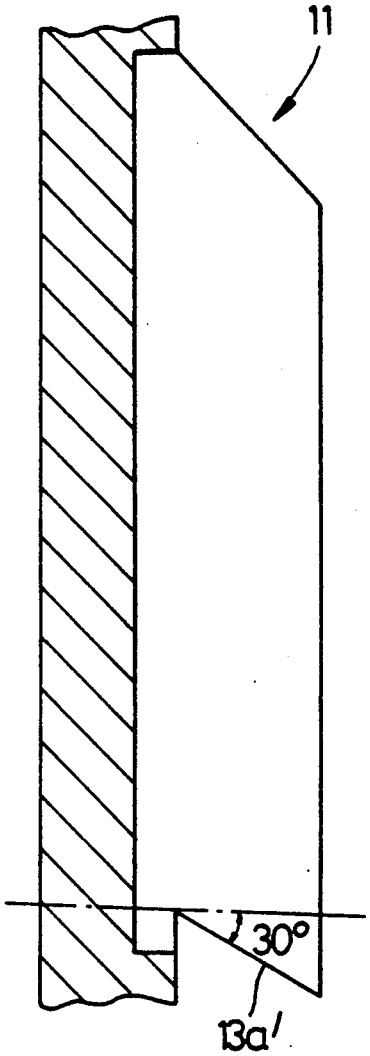

Furthermore it will be appreciated that a wide range of angles for the cutting edge 12*a'*, 13*a'* could be employed to achieve one or more of the benefits of the invention; that is improved chip control, improved cutting rate, and improved cutting length/depth. For example in the embodiment shown in FIGS. 10 and 11 the cutting edges are respectively angled at about 5° and 30°.

It will also be appreciated that in essence it is the cutting edges of the blades alone which need be angled in accordance with the invention when the tool is actually cutting and variations which could achieve a similar result such as angling the whole blades with respect to the body or using cutting elements arranged along the radial axis but having angled lower edges, are all within the scope of the invention.

It should also be noted that the opposed cutting edges such as 12*a'*, 13*a'* do not have to be equally angled or cut the casing simultaneously, or be positioned alternately with respect to one another.

It will further be appreciated that the invention is not limited to the milling tool illustrated in the drawings, but may be applied with advantage to other milling tools for example those having radially expandable cutting blades such as shown in U.S. Pat. No. 4,887,688.

We claim:

1. A tool for milling a down-hole casing or tubing comprising a tubular body rotatable about its longitudinal axis and having a longitudinal passage therethrough;

means at a first end of the cylindrical body for connection to a drive means to rotate the body, said first end to form the upper end of the body in the working position;

at least one first blade extending outwardly from the cylindrical body and having a lowermost cutting edge extending upwardly from its innermost portion at an angle of from about 2° to about 60° to a radial plane perpendicular to said longitudinal axis;

at least one second blade extending outwardly from the cylindrical body and having a lowermost cutting edge extending downwardly from its innermost portion at an angle of from about 2° to about 60° to a radial plane perpendicular to said longitudinal axis.

2. A tool as claimed in claim 1 wherein the radially innermost portion of the cutting edge of the first blade is located at a lower longitudinal location on the cylindrical body than the radially innermost portion of the cutting edge of the second blade.

3. A tool as claimed in claim 2 wherein the radially innermost portion of the cutting edge of the first blade is substantially level in the longitudinal direction with the radially outermost portion of the cutting edge of the second blade.

4. A tool as claimed in claim 1 wherein the angles of the cutting edges of the first and second blades are substantially equal.

5. A tool as claimed in claim 1 wherein the cutting edge of the first and second blades are diametrically opposed.

6. A tool as claimed in claim 1 wherein each of the cutting edges of the first and second blades are angled between about 2° to about 45°.

7. A tool as claimed in claim 6 wherein each of the cutting edges are angled between about 2° to about 20°.

8. A tool as claimed in claim 7 wherein each of the cutting edges are angled between about 10° to about 15°.

9. A tool as claimed in claim 1 wherein there is a plurality of first and second blades alternately spaced around the cylindrical body.

10. A tool as claimed in claim 1 wherein at least one cutting element is attached to each blade and arranged such that, in the working position, the lowermost edge of the cutting element(s) act as the cutting edge, said elements being such as to act as chip breakers.

11. A tool as claimed in claim 10 wherein, each cutting element has a plurality of radially extending protrusions to form chip breakers.

12. A tool as claimed in claim 1 wherein the blades are planar and are located parallel to the longitudinal axis of the body and the cutting edges extend substantially along a radial axis of the body.

13. A tool as claimed in claim 1 wherein the blades are planar and are located in slots in the body which are parallel to the longitudinal axis of the body and off set from a radial axis.

14. A tool as claimed in claim 1 wherein at least six blades are equidistantly peripherally spaced about the body.

* * * * *